US005628838A

United States Patent [19]

Schapira et al.

[11] Patent Number: 5,628,838

[45] Date of Patent: May 13, 1997

[54] CONCENTRATE FOR ACTIVATING AND DEFINING BATH AND BATH OBTAINED FROM THIS CONCENTRATE

[75] Inventors: Joseph Schapira, Paris; Patrick Droniou, Colombes; Michel Sudour, Luzarches; Véronique LeRouge née Bouaffre, Bois Colombes, all of France

[73] Assignee: C.F.P.I societe anonyme, Gennevilliers, France

[21] Appl. No.: 511,298

[22] Filed: Aug. 4, 1995

Related U.S. Application Data

[63] Continuation of Ser. No. 328,569, Oct. 24, 1994, abandoned, which is a continuation of Ser. No. 9,745, Jan. 27, 1993, abandoned.

[30] Foreign Application Priority Data

Jan. 29, 1992 [FR] France ..... 92 00945

[51] Int. Cl.$^6$ ..... C23C 22/80

[52] U.S. Cl. ..... 148/250; 148/254

[58] Field of Search ..... 148/254, 250

[56] References Cited

U.S. PATENT DOCUMENTS

| | | | |
|---|---|---|---|
| 4,678,519 | 7/1987 | Schapira | 148/254 |
| 5,112,414 | 5/1992 | Brands | 148/254 |
| 5,160,551 | 11/1992 | Rein | 148/254 |

*Primary Examiner*—Sam Silverberg
*Attorney, Agent, or Firm*—Larson & Taylor

[57] ABSTRACT

Concentrate for activating and refining bath employed in processes of zinc phosphatization, characterized by the fact that it is based on an aqueous dispersion containing from 2 to 20% by weight of Jernstedt salts, the concentration of titanium in the dispersion consequently being from 140 to 10,000 ppm of Ti, this dispersion in addition containing:

a proportion of from 0.2 to 8% by weight of at least one dispersing or sequestering agent and a proportion of from 0.05 to 7% by weight of at least one thickener based on polysaccharide.

6 Claims, No Drawings

CONCENTRATE FOR ACTIVATING AND DEFINING BATH AND BATH OBTAINED FROM THIS CONCENTRATE

This application is a continuation of application Ser. No. 08/328,569 filed Oct. 24, 1994 now abandoned which is a continuation of Ser. No. 08/009,745 filed Jan. 27, 1993 now abandoned.

The invention has as its object a liquid concentrate for providing, by dilution with a suitable quantity of water, an activating and refining bath containing titanium for use in a process of crystalline zinc phosphatization.

It also relates to the activating and refining bath obtained from the said concentrate.

Processes for crystalline zinc phosphatization on substrates of steel, aluminium, galvanized steel or galvanized steel alloyed with nickel, cobalt, aluminium or iron are widely used for protecting the said substrates against corrosion or for lowering the coefficients of friction when these substrates are subjected to cold working.

They generally comprise:

one ou more stages of alkaline degreasing, one or more stages of rinsing with runnning tap water, a stage of activation and refining, a stage of zinc phosphatization properly speaking, one or more stages of rinsing with water, preferably a stage of final passivating rinsing, in particular with salts of hexavalent chromium or of mixtures of hexavalent chromium and trivalent chromium.

Before the phosphatization treatment properly speaking, the stage of activation is capable of producing chemical heterogeneities on the cleaned metallic surface, thus promoting germination of the layer of crystalline phosphates and enabling a fine and dense coating to be formed. Such a coating is desired either for improving the adherence of a layer of paint which may subsequently be applied and improving the resistance to corrosion in the event of damage to the layer or skin of paint, or for depositing firmly adhering crystals on the metallic substrate in the context of a cold forming treatment.

The stages in particular of activation and phosphatization are generally carried out by spraying a suitable bath on the substrate, by steeping the substrate in the bath or by successive spraying and steeping.

The stage of activation may possibly be carried out at the same time as the stage of degreasing by mixing the aqueous degreasing solution with a concentrated activating product or by preparing a degreasing-activating bath from a concentrated degreasing composition containing an activating concentrate. Such simultaneity of the two stages is practised in installations for the treatment of surfaces in which only spraying is carried out at the stage of phosphatization. If, however, the phosphatization stage also includes a phase of immersion, fine and dense phosphatization can only be achieved by means of an independent stage of activation.

Titanium, which is employed at the stage of activation and refining, constitutes the refining agent; the activating and refining baths are generally baths based on titanium salts and contain alkali phosphates.

It is known to prepare them from solid pulverulent concentrates generally consisting of mixtures of alkali phosphates and colloidal titanium salts known under the name of Jernstedt salts which are described, for example, in U.S. Pat. No. 2,456,947.

Such a Jernstedt salt may be obtained by mixing 95 parts of disodium phosphate with 5 parts of potassium fluotitanate in a sufficient quantity of water to dissolve them; polyphosphates of sodium and potassium may also be added to this mixture, in particular in a proportion of 1 to 300 parts by weight of $P_2O_7^{4-}$. The water is then removed from the mixture by evaporation until a pulverulent product is obtained.

The sulphate, oxide or oxysulphate of titanium may be used instead of potassium fluotitanate as source of titanium.

One example of a Jernstedt salt commonly employed and marketed by the Applicant under the trademark FIXODINE 5 consists of:

from 0.7 to 5% by weight of titanium expressed as titanium (IV) in the form of titanium phosphate, from 85 to 99.3% by weight of sodium phosphate and from 0 to 10% by weight of sodium polyphosphate.

As indicated above, the known concentrates used for the preparation of the activating and refining baths are pulverulent products.

They have the following disadvantages:

they contain water insofar as in the course of their manufacture it is not considered economical to heat them to temperatures above 110° C. for complete removal of the water so that part of the water is left in the powder obtained; this frequently leads to the formation of lumps which are difficult to dissolve; the formation of these lumps is also promoted by the humidity in the workshops in which the surface treatment is carried out and by the hygroscopicity of the powder;

they contain a not negligible proportion of fine particles capable of polluting the atmosphere of the place where they are employed; further, for preparing the activating bath, the user is required to prepare an aqueous mother solution from the concentrate; this mother solution must be prepared with vigorous stirring since the Jernstedt salts are highly insoluble under such conditions of preparation;

they must be introduced evenly and hence preferably automatically into the water of dilution at the time of preparation of the activating bath since the stage of activation induces nucleation of the subsequent phase of phosphatization; however, the apparatus for automatic introduction of powder are in many cases designed with endless screws placed under feed hoppers for the powder and these screws compress the powder and frequently cause the formation of lumps which block the operation of the said screws.

This presentation in powder form has hitherto been necessary due to the fact that once the Jernstedt salt has been introduced into water, it forms a suspension of insoluble crystals after several hours and these crystals are capable of increasing in size in the course of time, whereas it is known that only fine crystals (<3 μm) have the desired activating effect.

It has also been proposed to employ liquid concentrates (EP-A-454 212) which are based on Jernstedt salts and which, due to their liquid nature, do not have the disadvantages due to the pulverulent nature of the solid concentrates described above.

However, although these liquid concentrates can be stored without sedimentation for three months due to the addition of thickeners, in particular polysaccharides which are well known for their multiple thickening properties, they have the major disadvantage that they must contain a sufficiently high concentration of titanium so that when diluted with the normal quantity of water they will provide an effective activating bath after several months' storage, that is to say they must have a titanium content, still in a finely crystallized state, capable of conferring on the bath the required activating properties; such a high titanium content in the concentrate has the result that an activating bath which has been prepared from this concentrate immediately after preparation of the latter or a short time thereafter and therefore before crystal growth has taken place will in turn have such a high titanium concentration that the treatment of a substrate with such an activating bath will result in a surface which is too highly activated so that at the stage of phosphatization proper the thickness of the layer will be virtually zero; this layer will therefore be a layer of passivation rather than of phosphatization.

It is thus a main object of the present invention to provide a concentrate suitable for the preparation of activating and refining baths of the type in question which do not have the disadvantages of the concentrates of the prior art.

It is to the merit of the Applicant company to have found that this object is achieved if the said concentrate is in the form of an aqueous dispersion containing from 2 to 20% by weight of Jernstedt salt, the concentration of titanium in the dispersion being therefore from 140 to 10,000 ppm of Ti, this dispersion in addition containing:

a proportion of from 0.2 to 8% by weight of at least one dispersing or sequestering agent to be defined hereinafter and a proportion of from 0.05 to 7% by weight of at least one thickener based on polysaccharide also defined hereinafter.

The concentrate thus constituted is stable for at least three months both physically and in its activity and can at any time, that is to say immediately after its preparation or equally well after several months' storage, provide, by dilution with the same quantity of water, an activating and refining bath having a titanium content of from 1 to 75 ppm and giving satisfactory results as regards activation of the treated substrate.

The invention therefore has as its object, by way of concentrate suitable for the preparation of activating and refining baths employed in zinc phosphatization processes, an aqueous dispersion of Jernstedt salts containing from 2 to 20% by weight of these salts, which corresponds to a concentration of Ti of from 140 to 10,000 ppm, the said dispersion containing, in addition:

a proportion of from 0.2 to 8% by weight of at least one dispersing or sequestering agent selected from the group comprising alkali metals or ammonium phosphonates, alkali or ammonium salts of sequestering carboxylic acids, and any combination of several of these derivatives, it being understood that the phosphonates are preferably selected from the group comprising those of hydroxymethyl-phosphonic acid, hydroxypropyl-phosphonic acid 1-hydroxyethylidene-1,1-diphosphonic acid, amino-tri(methylene-phosphonic) acid, ethylene-diamino-tetra(methylene-phosphonic) acid and 2-phosphono-butane-1,2,4-tricarboxylic acid and that among the sequestering carboxylic acids, nitrilotriacetic or NTA is preferred, a proportion of from 0.05 to 7% by weight of at least one thickener based on polysaccharide obtained by fermentation of a nutrient medium based on a carbohydrate consisting in particular of a sugar such as glucose, sucrose, fructose, maltose, lactose or galactose, and/or on a source of organic and/or inorganic nitrogen consisting in particular of an alkali metal nitrate, an inorganic salt of ammonium, the caseinate of sodium and the soluble extract of corn by the action of a microorganism selected from the class of Xanthomonas or Sclerotia, *Xanthomonas campestris* or *Sclerotium rolfsii* being preferred.

The proportion of Jernstedt salt is preferably from 4 to 15% by weight of the liquid concentrate.

The proportion of sequestering or dispersing agent is preferably from 4 to 15% by weight of the liquid concentrate.

The proportion of polysaccharide is preferably from 4 to 15% by weight of the liquid concentrate.

The liquid concentrate according to the invention may contain anti-freeze compounds so that it can be stored at temperatures below 0° C.; the anti-freeze compound may be selected from glycol derivatives such as ethyleneglycol, propylene-glycol or high molecular weight glycols or also nitrogen derivatives such as urea.

The pH of the liquid concentrate is preferably adjusted to a value from 7 to 10 and more preferably from 7 to 9; this may be carried out by using an alkaline derivative such as soda, potash, the carbonates of alkali metals or of ammonium hydroxide, phosphates such as trisodium or tripotassium phosphate, pyro- or tripolyphosphates of sodium or potassium and alkali or ammonium salts of carboxylic acids such as citrates.

The activating and refining bath according to the invention obtained by dilution of the said concentrate to 3–30 g/l of water contains:

from 60 to 6000 mg/l of Jernstedt salt, that is to say from 1 to 75 mg/l of titanium in the form of titanium phosphate in a matrix of alkali phosphates, from 15 to 1500 mg/l of a derivative of a sequestering carboxylic acid and/or of a dispersing phosphonic acid, from 3 to 600 mg/l of a polysaccharide obtained by fermentation of a nutrient medium by a microorganism, the volume being made up to 1 liter with water.

To demonstrate the suitability of the concentrates according to the invention for providing, by a constant dilution either just after their preparation or at any time and at least during three months after their preparation, activating and refining baths which are entirely satisfactory in processes of zinc phosphatization, tests were carried out comprising a measurement of the efficiency of the baths obtained by dilution of the concentrates according to the invention in a process of surface treatment comprising phosphatization, on the one hand immediately after dilution and on the other hand after storage at various temperatures.

The surface treatment process, which is the same for all the tests for efficiency, comprises the following stages:

alkaline degreasing by immersion at 60° C. for 3 minutes in a 2% aqueous solution of an alkali silicate degreasing agent marketed by the Applicant Company under the trademark RIDOLINE 1550 CF/2 with the addition of 0.2% of a surface-active compound also marketed by the Applicant Company under the trademark RIDOSOL 550 CF, rinsing with running tap water at room temperature, activation by immersion at room temperature for 1 minute in a dilute bath prepared from water and the liquid concentrate according to the invention, phosphatization with zinc in an aqueous solution based on acid phosphates of zinc marketed by the Applicant Company under the trademark GRANODINE 958 CF for 3 minutes at 53° C., rinsing with running tap water, drying for 5 minutes in a current of hot air at 80° C.

Since the object here was to study the influence of various activating baths on the morphology and quantity of zinc phosphate crystals deposited during the stage of activation, the subsequent conventional stages of passivation and painting were omitted.

The studies of morphology may be carried out with a scanning electron microscope adjusted for 1500 times enlargement.

The studies of stability may be carried out by weighing the quantity of zinc phosphate deposited after dissolution of the deposit in a scouring medium.

The substrates used for the tests are sheets of cold rolled steel, of electrogalvanized steel or of hot galvanized steel measuring 10 cm×20 cm×0.7 mm.

After this storage and after the fractions stored at 4° C. and 40° C., respectively, have been adjusted to 20° C., they are checked to confirm that none of the three fractions shows any appreciable sign of phase separation, sedimentation, crystallization or thickening.

The activating bath obtained from this concentrate is studied by comparison with a bath prepared from a Jernstedt salt in powder form (marketed by the Applicant Company under the trademark FIXODINE 5).

The surface treatment described above is carried out and the following results are recorded.

TABLE I

| | Size of crystals (in micrometers) | | | | |
|---|---|---|---|---|---|
| | Storage of | Concentration | Size of crystals (in μm) Substrate | | |
| Activating bath obtained from | concentrate (days) | of the bath (g/l) | Steel | Galvanized | Electro-galvanized |
| Concentrate according to the invention | 0 | 10 | 1.5 | 2.0 | 2.0 |
| | 90 | 10 | 2.0 | 4.0 | 2.0 |
| Conventional concentrate (FIXODINE 5) | 0 | 1 | 2.5 | 4.0 | 3.0 |
| | 90 | 1 | 2.5 | 4.0 | 3.0 |

TABLE II

| | Weight of layer ($g/m^2$) | | | | |
|---|---|---|---|---|---|
| | Storage of | Concentration | Weight of layer ($g/m^2$) Substrate | | |
| Activating bath obtained from | concentrate (days) | of the bath (g/l) | Steel | Galvanized | Electro-galvanized |
| Concentrate according to the invention | 0 | 10 | 2.0 | 1.8 | 2.2 |
| | 90 | 10 | 2.2 | 3.1 | 2.4 |
| Conventional concentrate (FIXODINE 5) | 0 | 1 | 2.3 | 2.7 | 2.7 |
| | 90 | 1 | 2.3 | 2.7 | 2.7 |

The invention will be better understood with the aid of the non-limiting examples given below in which advantageous embodiments of the invention are described.

EXAMPLE 1

100 g of Jernstedt salt (marketed by the Applicant Company under the trademark FIXODINE 5), 4 g of polysaccharide (marketed by KELCO Company under the trademark KELZAN S) and 10 g of the tetrasodium salt of 1-hydroxy-ethylidene-1,1-diphosphonic acid are diluted with vigorous stirring in 500 g of demineralized water at 60° C.

The composition is made up to 1000 g by the addition of demineralized water.

This preparation is homogenised and is used as liquid concentrate according to the invention.

It is diluted to 10 g per liter of demineralized water to form a dilute aqueous activating solution or activating bath.

The said liquid concentrate is homogeneous and opalescent. It is divided into three equal fractions which are stored for 3 months at 4° C., 20° C. and 40° C., respectively.

Tables I and II show that the liquid concentrate according to the invention is stable after 3 months' storage and provides baths having an activity equivalent to that of baths obtained at the end of three months from solid pulverulent concentrates of the prior art.

EXAMPLE 2

Liquid concentrates are prepared for activating baths by the method identical to that described in Example 1 but with the polysaccharide replaced by different thickeners conventionally used for stabilizing aqueous concentrates containing dispersions of solids.

The other ingredients are unchanged.

Samples of these concentrates are stored at 4° C., 20° C. and 40° C., respectively, and the time taken for separation of more than 10% by volume of concentrate to appear is noted, this phenomenon being considered unacceptable for the stability of a liquid concentrate.

The results are summarized in Table III.

TABLE III

| Nature of thickener | Quantity in g in 1000 g of concentrate | SEPARATION Time in days required for separation of 10% of the composition after storage at 4° C. | 20° C. | 40° C. |
|---|---|---|---|---|
| None | | 0 | 0 | 0 |
| Ammonium alginate (trademark CECALGUM A 500) | 20 | 7 | 3 | 1 |
| Cellulose (CMC) (trademark BLANOSE 7 HC) | 17 | | unpumpable gel in 2 days | |
| Aluminosilicate (trademark CLARSOL FB2) | 30 | 15 | 15 | 8 |
| Magnesium silicate (trademark BENTONE 38) | 100 | 0 | 0 | 0 |
| Mg and Al silicate (trademark VEEGUM F) | 40 | 30 | 30 | 7 |

It will have been noted that
CECALGUM A 500 is marketed by the company CECA
BLANOSE 7 Hc is marketed by the company HOECHST
CLARSOL FB2 is marketed by the company CECA
BENTONE 38 is marketed by the company CECA
VEEGUM F is marketed by the company VAN DER BILT.

Table III clearly shows that none of the thickeners, even when based on cellulose such as carboxymethyl cellulose and used at the concentrations conventionally employed for producing a viscosity of from 800 to 2000 cps measured in a Brookfield viscosimeter at 20 rpm/min, provides a stability comparable to that obtained in Example 1.

The nature of the thickener is thus a determining factor.

EXAMPLE 3

Liquid concentrates are prepared for activating baths in a manner identical to that described in Example 1 but with 1-hydroxyethylidene-1,1-diphosphonic acid replaced by various other dispersing agents.

The other ingredients are unchanged.

Samples of these concentrates are stored at 4° C., 20° C. and 40° C., respectively, and the time taken for the appearance of a persistent crystallization when the temperature returns to 20° C. is noted, the appearance of this phenomenon being regarded as unacceptable for a liquid concentrate.

The concentrates are then diluted to 10 g/l in demineralized water to form activating baths and the surface treatment described in Example 1 is carried out on steel sheets.

The product is checked to ascertain whether it is still activating (crystals comparable to those obtained in Example 1).

The results are summarized in Table IV.

TABLE IV

| Nature of dispersing or sequestering agent | Quantity in g in 1000 g of concentrate | Storage time (days) at the end of which coarse crystals appear After storage 4° C. | 20° C. | 40° C. | Activating effect after dilution |
|---|---|---|---|---|---|
| None | | >90 | >90 | >90 | NEGATIVE |
| Polyacrylic acid (COATEX TH 50-50) | 20 | >90 | >90 | >90 | NEGATIVE |
| NTA | 10 | >90 | >90 | >90 | POSITIVE |
| NTA | 120 | 4 | 4 | >90 | POSITIVE |
| ATP | 20 | >90 | >90 | >90 | POSITIVE |
| Tetrapotassium pyrophosphate | 100 | >90 | >90 | >90 | NEGATIVE |
| Sodium tri-polyphosphate | 100 | >90 | >90 | >90 | NEGATIVE |
| Sodium hexametha-phosphate | 100 | >90 | >90 | >90 | NEGATIVE |

COATEX TH 50-50 is marketed by COATEX Company
NTA: Sodium salt of nitrilotriacetic acid
ATP: Pentasodium salt of amino-tri(methylenephosphonic) acid.

An examination of the results summarized in Table IV clearly shows that only NTA and ATP used in suitable proportions have the advantage not only of rendering the concentrate according to the invention stable as regards crystallization but also of ensuring that after the concentrate has been stored at different temperatures, it can still provide baths which are usable by virtue of their activating properties.

Such a result was not obvious to the man skilled in the art since he would have expected all dispersing agents and/or sequestering agents to act in the same manner.

The necessity for the simultaneous presence in the liquid concentrate according to the invention of an effective quantity of a sequestering and/or dispersing agent and of a polysaccharide selected from their respective groups indicated above is thus clearly established.

We claim:

1. Aqueous concentrate having a pH from 7 to 10 for preparing an activating and refining bath employed in processes of zinc phosphatization, based on an aqueous dispersion of Jernstedt salts, said concentrate containing from 2 to 20% by weight of said Jernstedt salts, from 0.2 to 8% by weight of at least one dispersing or sequestering agent selected from the group consisting of alkali and ammonium phosphonates of hydroxymethylphosphonic acid, hydroxypropylphosphonic acid, 1-hydroxyethylidene-1,1-diphosphonic acid, amino-tri(methylene-phosphonic) acid, ethylene-diamino-tetra(methylene-phosphonic) acid, and 2-phosphono-butane-1,2,4-tricarboxylic acid, from 0.05 to 7% by weight of at least one thickener based on a polysaccharide obtained by fermentation, under the action of a microorganism selected from the group consisting of the classes of Xanthomonas and Sclerotia, using a nutrient medium based on at least one constituent selected from the group consisting of glucose, sucrose, fructose, maltose, lactose and galactose, and a member selected from the group consisting of alkali nitrate and inorganic ammonium salt and mixtures thereof, the caseinate of sodium and the soluble extract of corn.

2. Activating and refining bath having a pH from 7 to 10, obtained by dilution of the concentrate according to claim 1, to a concentration corresponding to 3 to 30 g of concentrate/liter of water and containing from 60 to 6000 mg/l of Jernstedt salt, which is 1 to 75 mg/l of titanium in the form of titanium phosphate in a matrix of alkali phosphates, from 15 to 1500 mg/l of a dispersing phosphonic acid compound selected from the group consisting of alkali and ammonium phosphonates of hydroxymethylphosphonic acid, hydroxypropylphosphonic acid, 1-hydroxythylidene-1,1-diphosphonic acid, amino-tri(methylene-phosphonic) acid, ethylene-diamino-tetra (methylene-phosphonic) acid, and 2-phosphono-butane-1,2,4-tricarboxylic acid, from 3 to 600 mg/l of a polysaccharide obtained by fermentation, under the action of microorganism selected from the group consisting of the classes of Xanthomonas and Sclerotia using a nutrient medium based on at least one constituent selected from the group consisting of glucose, sucrose, fructose, maltose, lactose and galactose, and a member selected from the group consisting of an alkali nitrate and inorganic ammonium salt and mixtures thereof, the caseinate of sodium and the soluble extract of corn, the volume being made up to 1 liter with water.

3. Activating and refining bath having a pH from 7 to 10, obtained by dilution of the concentrate according to claim 1, to a concentration corresponding to 3 to 30 g of concentrate/liter of water and containing from 60 to 6000 mg/l of Jernstedt salt, which is 1 to 75 mg/l of titanium in the form of titanium phosphate in a matrix of alkali phosphates, from 15 to 1500 mg/l of a dispersing phosphonic acid compound selected from the group consisting of alkali and ammonium phosphonates of hydroxymethylphosphonic acid, hydroxypropylphosphonic acid, 1-hydroxythylidene-1,1-diphosphonic acid, amino-tri(methylene-phosphonic) acid, ethylene-diamino-tetra (methylene-phosphonic) acid, and 2-phosphono-butane-1,2,4-tricarboxylic acid, from 3 to 600 mg/l of a polysaccharide obtained by fermentation, under the action of microorganism selected from the group consisting of *Xanthomonas campestris* and *Sclerotia rolfsii,* using a nutrient medium based on at least one constituent selected from the group consisting of glucose, sucrose, fructose, maltose, lactose and galactose, and a member selected from the group consisting of an alkali nitrate and inorganic ammonium salt and mixtures thereof, the caseinate of sodium and the soluble extract of corn, the volume being made up to 1 liter with water.

4. Concentrate according to claim 1, wherein the concentration of Jernstedt salt is comprised between 4 and 15% by weight of the liquid concentrate.

5. Concentrate according to claim 1, wherein the proportion of sequestering or dispersing agent is comprised between 0.5 and 5% by weight of the liquid concentrate.

6. Concentrate according to claim 1, wherein the proportion of polysaccharide is comprised between 0.1 and 2% by weight of the liquid concentrate.

* * * * *

UNITED STATES PATENT AND TRADEMARK OFFICE

CERTIFICATE OF CORRECTION

PATENT NO. : 5,628,838

DATED : May 13, 1997

INVENTOR(S) : SCHAPIRA et al

It is certified that error appears in the above-indentified patent and that said Letters Patent is hereby corrected as shown below:

Title page: item [54] and col. 1, lines 1-3, the title should read as follows:

--[54] CONCENTRATE FOR ACTIVATING AND REFINING BATH AND BATH OBTAINED FROM THIS CONCENTRATE--

Signed and Sealed this

Fourth Day of November, 1997

*Attest:*

Bruce Lehman

BRUCE LEHMAN

*Attesting Officer*

*Commissioner of Patents and Trademarks*